73-151 SR
10/16/84 OR 4,476,715

United States Patent [19]
Murphy

[11] Patent Number: 4,476,715
[45] Date of Patent: Oct. 16, 1984

[54] MUD METERING TANK MONITORING SYSTEM

[76] Inventor: Jack L. Murphy, 14215 Paradise Valley, Houston, Tex. 77069

[21] Appl. No.: 474,387

[22] Filed: Mar. 11, 1983

[51] Int. Cl.[3] ..... E21B 47/00
[52] U.S. Cl. ..... 73/151
[58] Field of Search ..... 73/151

[56] References Cited

U.S. PATENT DOCUMENTS

| | | | |
|---|---|---|---|
| 3,374,341 | 3/1968 | Klotz | 235/193 |
| 3,541,854 | 11/1970 | Jones et al. | 73/155 |
| 3,638,485 | 2/1972 | Knauth | 73/155 |
| 3,646,808 | 3/1972 | Leonard | 73/155 |
| 3,729,986 | 5/1973 | Leonard | 73/155 |
| 4,043,193 | 8/1977 | Bailey | 73/155 |
| 4,110,688 | 8/1978 | Bailey | 324/208 |

*Primary Examiner*—Howard A. Birmiel
*Attorney, Agent, or Firm*—Wilkinson, Mawhinney & Theibault

[57] ABSTRACT

The present disclosure is directed to a mud metering tank monitoring system for use with an oil well drilling derrick having a sheave on the crown block and a bottom pulley forming a block and tackle arrangement with a cable supporting a traveling block adapted to be attached at one end to a pipe string for raising and lowering the string in a drill casing by a prime mover the other end of said cable being a dead line and having a weight indicator connected thereto. The tank has a mud pump and a fluid connection between the tank and the drill casing. Pipe string counting means is connected to be driven by the sheave in the crown block and to indicate pipe stands lowered into and removed from the drill casing only when a pipe string is being carried by the traveling block. A pair of vertically spaced apart mud sensors are positioned in the mud metering tank, and a computer panel is connected to receive input signals from the pipe string counters and mud sensors. A display panel having indication means shows barrels of mud needed, barrels used, mud weight in the tank and stands pulled and is connected to receive signals from the computer panel. Recorder means is connected to the display panel to keep a running log of quantities listed on the panel plus date and time of day. This recorder is energized by the stand counter and records the above data each time a stand of drill pipe is removed from the hole, and an alarm circuit is in circuit with the computer panel and display panel to compare the actual volume of mud used with the calculated volume required and to energize the alarm to signal the driller should a discrepancy exceed a predetermined limit.

3 Claims, 3 Drawing Figures

MUD METERING TANK MONITORING SYSTEM

TECHNICAL FIELD

My invention relates to monitoring the flow of mud into and out of an oil well drill casing incident to the introduction and withdrawal of stands of pipe of a drill string by use of a mud metering tank monitoring system which will keep an accurate count of pipe pulled from the hole, the volume of mud needed to be pumped into the hole to replace the pipe removed, the volume of mud actually pumped into the hole, and the density of the mud pumped into the hole. An alarm will signal the driller should the difference between the required volume differ from the volume actually pumped into the hole exceed a predetermined limit.

BACKGROUND ART

The counting of stands of pipe introduced or withdrawn from a drill casing as well as the mud pumped into or out of the drill string hole is shown and described in U.S. Pat. Nos. 3,374,341; 3,646,808; 3,729,986 and 4,110,688.

The measuring of volume and density of fluids in a drilling system is shown in U.S. Pat. No. 4,043,193.

DISCLOSURE OF THE INVENTION

In accordance with my invention I provide a monitoring system at the drill site which cooperates with the derrick having a sheave on the crown block and a bottom pulley forming a block and tackle arrangement with a cable supporting a traveling block adapted to be attached at one end to a pipe string for raising and lowering the drill string in a drill casing by a draw works while the other end of the cable is a dead line having a weight indicator connected thereto so that only when the weight of the drill string is supported by the traveling block will the stand counter be actuated and wherein the volume and weight of drilling fluids are monitored into the bore hole and the calculation of drilling fluid volume required to replace the pipe removed from the hole and a comparison made to signal variances between fluid used and fluid required which exceed predetermined values.

When drill pipe is being withdrawn from a well under tripping conditions it is necessary to calculate the volume of drilling fluid required to fill the hole and to measure the volume of drilling fluid actually used to fill the hole.

To calculate the volume of fluid required, it is necessary to count the stands of pipe pulled and multiply by the volume per stand of the particular size drill pipe being used. This is done manually by the driller. There are two common methods of determining the volume of mud used; the first is to count the strokes of the mud pump and multiply this count by the volume per stroke, while the second method is to use a relatively small volume tank called a "trip tank" as the source of fluid for filling the hole and monitor the volume of fluid removed from it.

The present invention provides a system which automatically counts and displays the stands pulled, calculates and displays the volume of fluid required, measures and displays the volume used and displays the density of the fluid in the mud metering tank.

THE BEST MODE FOR CARRYING OUT THE INVENTION

Figure 1:
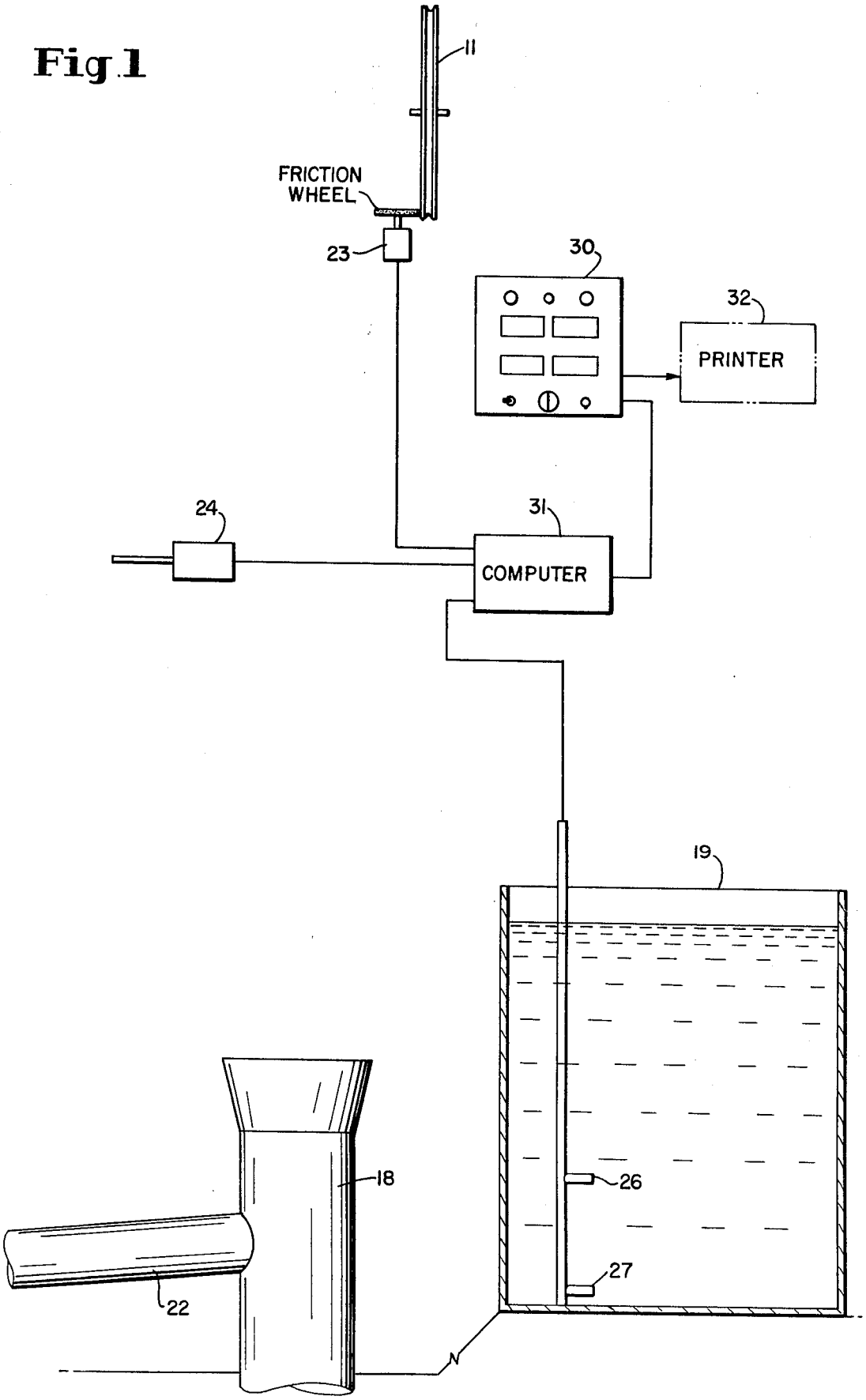
FIG. 1 is a schematic view of the drill hole, mud metering tank and monitoring system of the present invention.
Figure 2:
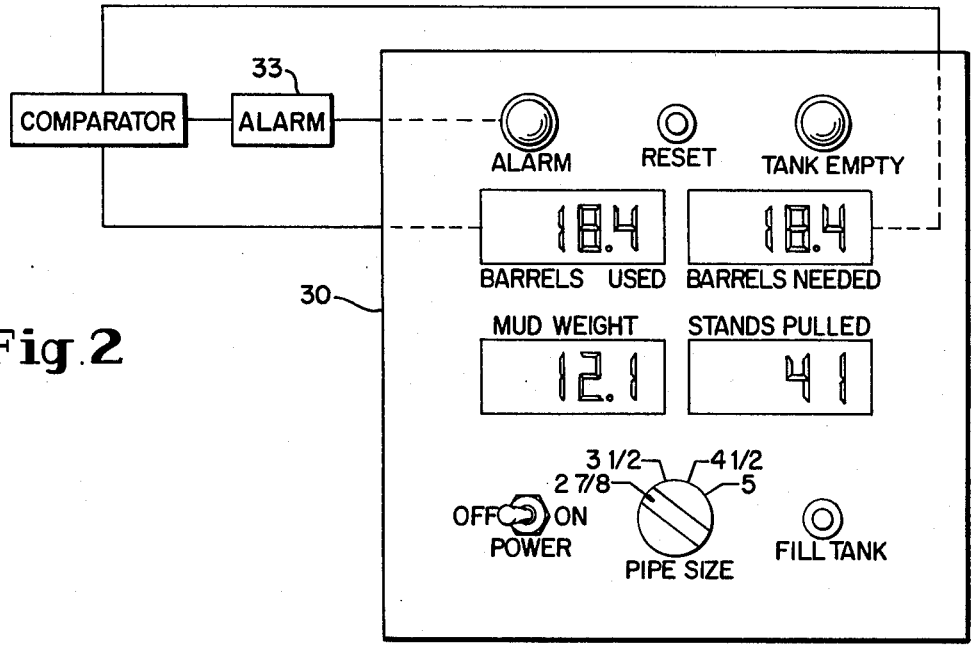
FIG. 2 is a front elevational view of the display panel to be observed by the driller.
Figure 3:
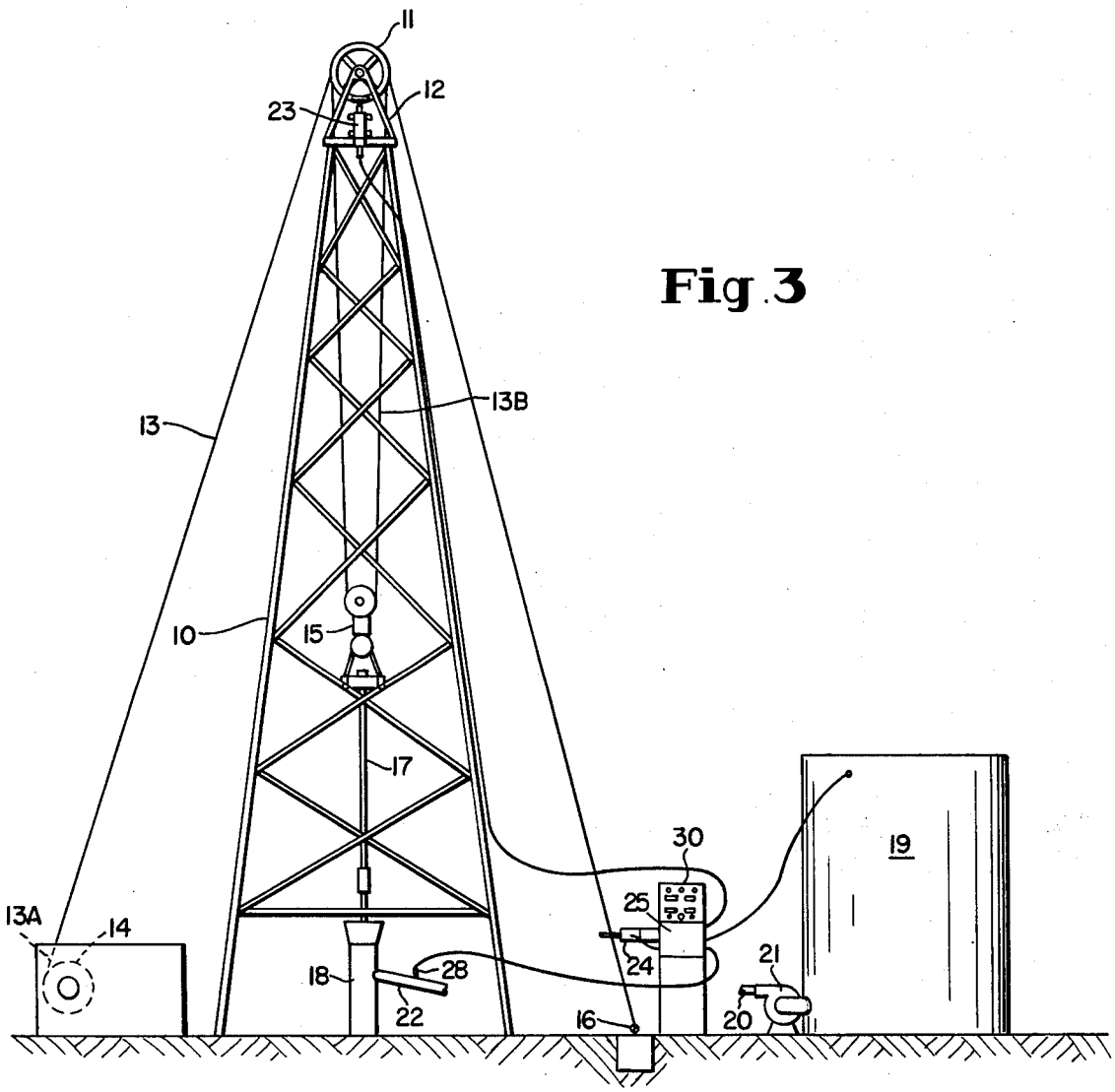
FIG. 3 is a schematic view of an oil well derrick structure having the pipe stand counter and metering tank monitoring system of the present invention applied thereto.

Referring to the drawings, 10 is a derrick having a sheave 11 on the crown block 12. A cable 13 has its end 13A connected to a draw works winch 14. Cable portion 13B passes over the sheave 11 supports the traveling block 15 and is dead ended at 16. The traveling block 15 pulls pipe stands 17 from the drill casing 18. The mud metering tank 19 has a fluid line 20 to the casing 18 under pressure from a mud pump 21 to supply mud to the casing. A mud return line 22 returns mud from the well casing to the mud metering tank 19.

As best seen in FIG. 1, to count stands removed from the hole, this system utilizes a shaft encoder 23 frictionally driven by the sheave 11 on the crown block 12 and a load detector 24 on the rig weight indicator 25. The system will indicate that a stand has been removed from the hole only if the encoder 23 indicates upward movement of the traveling block equal to a stand of pipe while the load detector 24 is indicating that the traveling is lifting the drill string. The load must be released from the traveling block before the display 30 indicates that a stand has been pulled. If the traveling block returns downward without releasing the load of the string, the system will not indicate that a stand has been removed since it obviously was lowered back into the hole.

The system is designed to count only when the weight indicator shows that the traveling block 14 is supporting the string of drill pipe. If the traveling block is raised when it is not attached to the drill string the system will not count.

The weight detector 24 may be a pressure switch which ties into the weight indicator hydraulics or it can be a transducer which transmits a quantitative value of the weight to the system.

In order to determine the density of fluid and the volume of fluid removed from the tank 19 a set of sensors 26, 27 of the type shown in U.S. Pat. No. 4,043,193 are positioned in the tank 19. They are positioned one foot apart vertically as shown in FIG. 1. The difference in pressure of the two sensors is measured to compute the density of the fluid. The pressure of the bottom sensor 27 is divided by the density to compute fluid depth. The depth is multiplied by a function of the cross sectional area of the tank 19 to compute volume. Sensors 26 and 27 are continuously measuring hydrostatic pressure and the system is continuously calculating and displaying fluid weight in the tank 19, and fluid volume removed from the tank.

When drill pipe is removed from the hole, the stand counter displays the number of stands removed, and the computer 31 calculates the volume of mud required to fill the hole and displays it on panel 30. As the hole is filled from the tank 19, panel 30 displays the volume of fluid actually used to fill the hole.

An alarm circuit 33 in the system compares the actual volume used to the calculated volume required. If the two are not equal within a predetermined amount an alarm 33 sounds and the alarm light on panel 30 flashes to alert the driller. The alarm may be visual or audible or both.

The computer panel 31 receives input signals from the encoder 23, the weight detector 24, and the sensors 26 and 27 in the tank 19. It then computes the number of stands pulled, the barrels needed to fill the hole, the actual number of barrels used to fill the hole, and the density of fluid in the tank 19. It then conducts this information to the driller's panel 30.

The system is programmed to print all the above data plus date and time of day. The printer is activated by the stand counter, and prints the above information every time a stand is pulled.

What I claim is:

1. For use with an oil well drilling derrick having a sheave on the crown block and a bottom pulley forming a block and tackle arrangement with a cable supporting a traveling block adapted to be attached at one end to a pipe string for raising and lowering the string in a drill casing by a prime mover the other end of said cable being a dead line and having a weight indicator connected thereto, a mud metering tank monitoring system comprising:

(a) a tank having a mud pump and a fluid connection between said tank and the drill casing, (b) pipe string counting means connected to be driven by a sheave in the crown block and to indicate pipe stands lowered into and removed from the drill casing only when a pipe string is being carried by the traveling block, (c) a pair of vertically spaced apart mud sensors in said mud metering tank, (d) a computer panel connected to receive input signals from elements (b) and (c), (e) a display panel having indication means showing barrels of mud needed, barrels used, mud weight in the tank and stands pulled connected to receive signals from said computer panel, (f) recorder means connected to said display panel to keep a running log of quantities listed in (e) plus date and time of day, the recorder is energized by the stand counter and records the above data each time a stand of drill pipe is removed from the hole, (g) and alarm circuit means in circuit with elements (d) and (e) to compare the actual volume of mud used with the calculated volume required and to energize an alarm to the driller should a discrepancy exceed a predetermined limit.

2. A mud metering tank monitor system as claimed in claim 1 wherein the pipe string counting means includes a weight sensing means to detect weight on the traveling block to only count up and down motion of the traveling block when it has a pipe load thereon.

3. A mud metering tank monitor system as claimed in claim 1 wherein the pipe string counting means includes a bi-directional shaft encoder which will count up and down to indicate the amount and direction of travel of the traveling block.

* * * * *